US005853264A

United States Patent [19]

Treveloni

[11] Patent Number: 5,853,264

[45] Date of Patent: Dec. 29, 1998

[54] BRIDGE, DOCK AND PIER SHORING-UP BULK-DELIVERY FLOATING CONVEYOR UNIT

[76] Inventor: Ronald Treveloni, 16 Brook Bridge Rd., Basking Ridge, N.J. 07920

[21] Appl. No.: 730,998

[22] Filed: Oct. 16, 1996

[51] Int. Cl.[6] ..... E02B 3/12

[52] U.S. Cl. ..... 405/17; 114/34

[58] Field of Search ..... 405/211, 16, 17, 405/18, 19; 114/26, 27, 31, 32, 33, 34; 414/140.9

[56] References Cited

U.S. PATENT DOCUMENTS

| | | | |
|---|---|---|---|
| 1,359,575 | 11/1920 | Chenoweth . | |
| 2,200,661 | 5/1940 | Templeton | 114/27 |
| 2,476,682 | 7/1949 | Pickett . | |
| 5,573,363 | 11/1996 | Rohr | 414/140.9 |

FOREIGN PATENT DOCUMENTS

| | | | |
|---|---|---|---|
| 54-0027191 | 3/1979 | Japan | 114/34 |
| 3929 | 8/1905 | United Kingdom | 405/17 |

*Primary Examiner*—Tamara L. Graysay
*Assistant Examiner*—Frederick L. Lagman
*Attorney, Agent, or Firm*—William T. Hough, Esq.

[57] ABSTRACT

An elongated narrow bulk delivery and depositing bouyant conveyor belt device is operable to shore up bridges, docks and/or piers in environments having operating space confined by low overhead and narrow berths between adjacent spaced apart pilings. The bouyant conveyor belt structure is alternately extendable and retractable in each of shallow and deep water. The bouyant conveyor belt structure is stabilized by one or between two linear axially extending substantially parallel sides of spaced apart floating platform barges. The barge(s) typically mount hopper and vibratable chute structure receivable of bulk typically rip rap fill material and feedable thereof onto the bouyant conveyor belt structure, thereafter deposited by a revolving of the conveyor belt structure.

29 Claims, 4 Drawing Sheets

BRIDGE, DOCK AND PIER SHORING-UP BULK-DELIVERY FLOATING CONVEYOR UNIT

SUMMARY OF THE INVENTION

A) BACKGROUND LEADING TO THE INVENTION

Due to the more prevalent use of side thrusters of large ships, which thrusters are used in the pushing of the ship away from docks, as opposed tc) the obsolete prior use of tugboats, coupled with the deepening of harbors and ports, the rip rap (bulk) ballast located beneath berths at several United States and foreign ports, has eroded away. This has left commercial docks, piers and bridges in a state of collapse of their support structures. This erosion of the ballast has resulted in numerous failures and others threatened, of the land side bulkheads and subsequent failure of and land areas beside the berths and docking facilities.

The problem became a major concern for (for example, but not limited to the Port Authority of New York and New Jersey due to their large dependence on commercial ship traffic in that area for not only export and import of hard goods but for also cruise shipping and transport of wastes and general transportation. The Port Authority had tried several solutions but all were very expensive and time consuming and major projects requiring the removal of sections of the piers which added to the construction costs and caused several total shutdowns of the piers during the extensive and time consuming construction. The problems have become a major difficulty for several other commercial ports especially in the southern United States due to the large cruise ships now being employed thereat.

The resulting typical problems to be overcome, and accordingly objects of the invention were determined by the inventor to include:

1) obtaining the ability to place the rock long distances from the pier and extending up to the bulkhead;
2) overcoming difficulties accompanying great water depths at the face, typically in excess of forty feet spaced away from the bulkhead, but as little as typically less than two feet in juxtaposition to the bulkhead, at times of low tide;
3) apart from accompanying variations in inadequately available operating space immediately above the water's surface resulting from low tide aforenoted consideration, with regard to low overhead structure of piers, bridges and the like, bulk shoring-up companies have been faced with overcoming limited laterally operating space occasioned as a result of "narrowly" spaced apart typically rows of piles that limited lateral work area from typically less than two feet to typical no more than about ten feet, further complicated with typically major normally present tidal and/or current flow factors and boat or ship wakes in the required working area of depositing sea bottom ballast; and
4) overcoming difficulties faced by avoiding nonuniform depositing and nonuniform deposited ballast—typically such as assorted rock, haphazard dumping and/or placing thereof typically and historically unacceptably causing sloughing of the ballast material(s) into immediately adjacent operating port waters and/or commercially navigable channels—such being also in violation of ordinances and laws regarding the maintenance of navigable channels; and
5) concurrently avoiding wasting and/or wasting-away of bottom ballast.

In anticipation of filing for patent coverage, a patentability search conducted in Class 405, sub-classes 15, 16 and 17, revealing no relevant prior art, typical prior art patent being:

a) Chenoweth U.S. Pat. No. 1,359,575 dated Nov. 23, 1949 which from a forward barge end from overhead barge structure lowers a pivoted distal end of a floated platform to thereby render an inclined plane (platform) to rest at its distal end; with the distal end on the sea bottom, a solid "imperforate flooring" (inclined platform) utilizes revolvable chains to cause unhardened in place reinforced plastic (unset) concrete to be deposited at the bottom resting end of the distal end; and b) A. B. Pickett U.S. Pat. No. 2,476,682 patented Jul. 19, 1949 likewise premixes in a screen box a hardening mixture of asphalt, cement, sand and gravel, transporting the filled screen boxes down a lowered ramp likewise having its distal end resting on the sea bottom, utilizing a revolvable conveyor unit. The lowerable ramp pivoted at its proximal end and lowered by cable(s) extending from a front end of a conventional sized barge, extends from a conventional barge, and the resting of the distal end thereof on the sea bottom is essential to the effecting of end to end depositing of the hardening or hardened premix composition contained in the series of separate screen boxes.

Such typical prior art patents fail to approach nor contemplate aforenoted problems and aforenoted objects achieved and constituting a part of this invention.

BRIEF SUMMARY OF THE INVENTION

Accordingly, broadly the invention is an aggregate delivery and depositing apparatus for shoring up upright underwater bridge, dock and pier supporting bulkhead and/or pilings. The aggregate delivery and depositing apparatus includes: at-least one (i.e. one or more of) a first floating aggregate conveyor structure(s) (and mechanism thereof) as a result of which there is transported (or transportable) aggregate (such as broken or crushed rock and/or stone or the like) toward an ultimate destination. That transporting capability includes for the depositing the aggregate thereon to and eventually onto underwater sea bottom to shore up or replace missing shoring underwater sea (vessel transportable water) bottom embodying the pier supporting upright underwater bulkhead and/or pilings. The inventions aggregate delivery and depositing apparatus (and mechanism thereof) is adjustably movable along it elongated (typically horizontally extending) length axis while remaining in its floating water borne state. In that suspended, floating state, transport mechanism and structure of the aggregate delivery and depositing apparatus effectively transports the aggregate. The invention apparatus includes structures providing for appropriate adjustments of distance and direction, and floating elevated distance above the sea bottom (or remaining pier (and/or bulkhead support ballast) adjustments. The inventive structure (and/or combinations) thereby are adapted for successful and effective dumping (i.e. depositing) of the aggregate at the predetermined locations substantially adjacent the pier supporting upright underwater bulkhead and/or pilings and possibly (normally) also at locations adjacent thereto and within a support distance therefrom.

In a first preferred embodiment as an improvement on the aforenoted broad invention, the at least one first floating aggregate conveyor apparatus (and mechanism thereof) has a first breadth width dimension, and a first axially elongated length that exceeds the first breadth width dimension. The at-least one first floating aggregate conveyor apparatus (and mechanism thereof) is further adapted to convey the aggregate axially along that axially elongated length.

In a second preferred embodiment as a further improvement on the first preferred embodiment, the at-least one first floating platform has sufficient mass to anchor and control orientation and extent of intermittent movement of the at-least one first floating aggregate conveyor apparatus (and mechanism thereof). Additionally, the at-least one first floating aggregate conveyor apparatus (and mechanism thereof) is adjustably intermittently movable relative to and attached to the at-least one first floating platform.

A third preferred embodiment as a further improvement on the second preferred embodiment, includes a first aggregate feed apparatus (and mechanism thereof) a) for sequentially aggregate feed receiving and aggregate feed transporting and b) for effecting transfer of transported aggregate onto the first floating aggregate conveyor apparatus (and mechanism thereof).

In a fourth preferred embodiment as an improvement on the third preferred embodiment, the first aggregate feed apparatus (and mechanism thereof) is mounted on the at least one first floating platform.

A fifth preferred embodiment as an improvement on the fourth preferred embodiment, includes two spaced apart rigidly interconnected ones of the first floating platform with the at-least one first floating aggregate conveyor apparatus (and mechanism thereof) moveably attached thereto.

In a sixth preferred embodiment as an improvement on the fifth preferred embodiment, the at-least one first floating aggregate conveyor apparatus (and mechanism thereof) is axially mounted onto and intermittently moveable on the flotation water surface in a first direction substantially parallel to the first axially elongated length between the two spaced apart rigidly interconnected the one first floating platform. Also, the at-least one first floating aggregate conveyor apparatus (and mechanism thereof) additionally is adapted for conveyor transporting of the aggregate along the first axially elongated length.

In a seventh preferred embodiment, as an improvement on the sixth preferred embodiment, the at-least one first floating aggregate conveyor apparatus (and mechanism thereof) includes at least one flotation apparatus (and mechanism thereof) for floatably supporting a conveyor belt apparatus (and mechanism thereof), and the conveyor belt apparatus (and mechanism thereof) for supporting and moving of the aggregate supportable thereon, and a conveyor belt, drive apparatus (and mechanism thereof) revolvably drivable of the conveyor belt apparatus (and mechanism thereof), the conveyor belt apparatus (and mechanism thereof) are jointly mounted on and floatably supported by the at least one aforenoted flotation apparatus.

In an eighth preferred embodiment, an improvement on the seventh preferred embodiment, there is included a second floating platform substantially rigidly attached to and spaced from the at-least one first floating platform a distance greater than the breadth width dimension and lesser than the length dimension. The first floating platform structure can be any one or more of a barge, a raft, a boat or the like. The second floating platform is positioned to effectively restrain the at least one first floating aggregate conveyor apparatus (and mechanism thereof) in the aforenoted orientation and first direction substantially such that it is aligned with the first axially elongated length. Thereby there is allowed movement of the at least one conveyor apparatus (and mechanism thereof) in the direction intermittently toward and away from predetermined points of deposit of conveyed aggregate.

In a ninth preferred embodiment as an improvement on the eighth preferred embodiment, the first aggregate feed apparatus (and mechanism thereof) comprises: a) an inclined slide structure and b) concave structure having upwardly extending wings or curved sides (and mechanism thereof) enhances tumbling of rock toward a lower-positioned central (intermediate) elongated axis thereof of the inclined slide structure. The inclined slide structure has first and second opposite ends. The first opposite end thereof is at-least one of elevated and elevateable, and the second opposite end is at least one of lowered or lowerable. Thereby movement of aggregate placed thereon is gravitationally enhanced from the first opposite end toward the second opposite end. Additionally the aggregate movement enhancing apparatus (and mechanism thereof) is for increasing ease of movement of aggregate from the first opposite end to the second opposite end. Additionally, the second opposite end is sufficiently (effectively) positioned substantially above the conveyor belt apparatus (and mechanism thereof) sufficiently for aggregate from the second opposite end to be deposited onto the conveyor belt apparatus (and mechanism thereof).

In a tenth preferred embodiment as an improvement on the ninth preferred embodiment, there is included vibrator apparatus (and mechanism thereof) for vibrating the inclined slide structure. Thereby gravitational movement of the aggregate is enhanced from the first opposite end to the second opposite end.

In an eleventh preferred embodiment as an improvement on the tenth preferred embodiment, the second opposite end is mounted on the at least one first flotation apparatus (and mechanism thereof).

In a twelfth preferred embodiment, as an improvement on the aforenoted broad invention, there is included in combination: a) at least one first floating platform having sufficient mass to anchor and control orientation and extent of intermittent movement of the at least one first floating aggregate conveyor apparatus (and mechanism thereof). Additionally the at-least one first floating aggregate conveyor apparatus (and mechanism thereof) is adjustably intermittently movable relative to and attached to the at least one first floating platform.

In a thirteenth preferred embodiment, as an improvement on the broad invention, there is included the improvement of the aforenoted third preferred embodiment.

In a fourteenth preferred embodiment, as an improvement on the broad invention, there is included the improvement of the aforenoted fourth preferred embodiment.

In a fifteenth preferred embodiment, as an improvement on the broad invention, there is included the improvement of the aforenoted fifth preferred embodiment.

In a sixteenth preferred embodiment, as an improvement on the broad invention, there is included the improvement of the aforenoted sixth preferred embodiment.

In a seventeenth preferred embodiment as an improvement on the broad invention, there is included the improvement of the aforenoted seventh preferred embodiment.

In a eighteenth preferred embodiment, as an improvement on the broad invention, there is included the improvement of the aforenoted eighth preferred embodiment.

In a nineteenth preferred embodiment, as an improvement on the broad invention, there is included the improvement of the aforenoted ninth preferred embodiment.

In a twentieth preferred embodiment, as an improvement of the nineteenth preferred embodiment, there is included vibrator apparatus (and mechanism thereof) for vibrating the inclined slide structure such that gravitational movement of the aggregate is enhanced from the first opposite end to the second opposite end.

In a twenty first preferred embodiment, as an improvement of the twentieth preferred embodiment, the second opposite end is mounted on the at least one first floating aggregate conveyor apparatus (and mechanism thereof).

In a twenty second preferred embodiment, as an improvement of the twentieth preferred embodiment, the first opposite end is mounted on the at-least one first floating aggregate conveyor apparatus (and mechanism thereof).

In a twenty third preferred embodiment, as an improvement of the seventh preferred embodiment, the flotation apparatus (and mechanism thereof) consists essentially of styrofoam.

In a twenty fourth preferred embodiment, as an improvement of the eleventh preferred embodiment, the flotation apparatus (and mechanism thereof) consists essentially of styrofoam.

In a twenty fifth preferred embodiment, as an improvement of the second preferred embodiment, there is included guidance structure mounted between and attached to each of a) the at-least one first floating aggregate conveyor apparatus (and mechanism thereof), and b) the at-least one first floating platform.

In a twenty sixth preferred embodiment, as an improvement of the second preferred embodiment, there is included the improvement of the twenty fifth preferred embodiment.

In a twenty seventh preferred embodiment, as an improvement of the twenty-seventh preferred embodiment, the at-least one first floating platform includes at-least one linearly extending side extending in the first linear direction.

In a twenty eighth preferred embodiment, as an improvement of the second preferred embodiment, there is the same improvement as the aforenoted twenty seventh preferred embodiment.

In a twenty ninth preferred embodiment, as an improvement on the twenty-fourth preferred embodiment, the in which the styrofoam has a width, length and thickness sufficient to maintain the conveyor belt apparatus (and mechanism thereof) at a level normally above water level when free of conveying aggregate thereon.

In a thirtieth preferred embodiment, as an improvement on the twenty seventh preferred embodiment, there is the same improvement as that of the twentieth preferred embodiment.

DRAWINGS DESCRIPTION

FIG. 1A diagramatically illustrates symbolically a typically right side view of a typical embodiment of the invention as a barge embodiment which is more fully described below.

FIG. 1B diagramatically illustrates symbolically a right side of the embodiment of FIG. 1A.

FIG. 1BB diagrammatically illustrates symbolically an enlarged view of a portion 1BB of FIG. 1B, in greater detail as to structural arrangements.

FIG. 1C diagramatically illustrates symbolically a top view as taken along lines 1C—1C of FIG. 1-B, of the embodiment of FIG. 1B.

FIG. 2A diagramatically illustrates symbolically a left side of an similar but alternate embodiment as a barge described below.

FIG. 2B diagramatically illustrates symbolically a forward end of the embodiment as taken along lines 2B—2B of FIG. 2A. FIG.

FIG. 1BB illustrates a view taken within the lined square of FIG. 1B.

FIG. 2C diagramatically illustrates symbolically the embodiment as taken along lines 2C—2C of FIG. 2B.

DETAILED DESCRIPTION

Figure 1A:
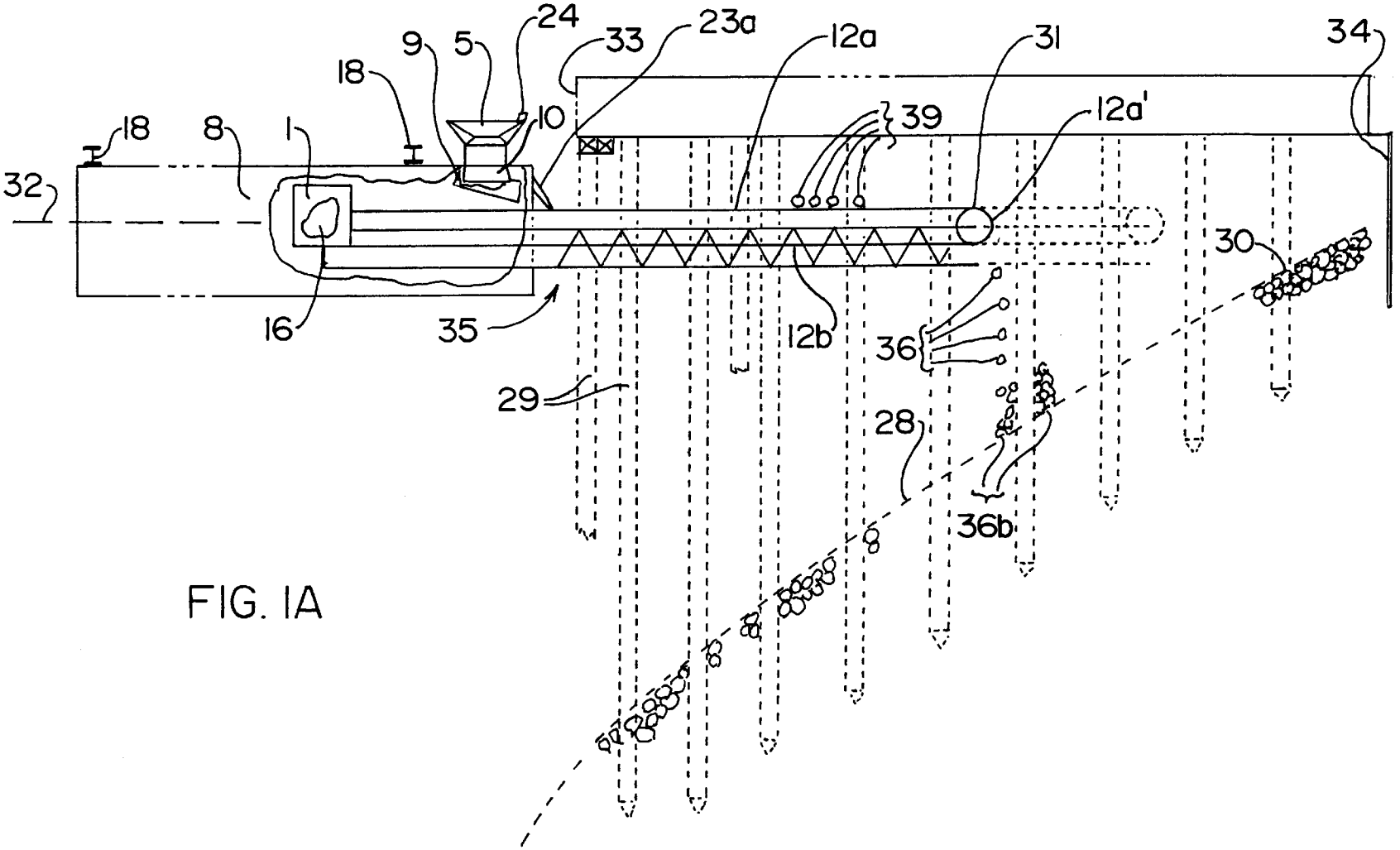

The invention was initially arrived at and developed to place typically rip rap and gravel fill beneath berths and piers at ship terminals which have been undermined typically by aforenoted side thrusters recently often a part of cruise ships and cargo transport ships. Typical problems to be overcome were deep water ranging from about five to forty feet, and zero head run (room) between the water level and the underside of the structure at typical high tide water level. The berth could be accessed only from the outer end and the conveyance tool had to place the material fifty to sixty feet from the front of the berth. Such were typical formidable obstacles heretofore not overcome—heretofore as aforestated shoring up (bulk laying) companies having resorted to tearing apart the overhead piers and/or docks, at great expense, shutdown time of commercial availability, and great inconvenience to the public and the shipping and tourist voyage commercial companies.

Apart from the broad invention described above, the inventor overcame the obstacles of the foregoing paragraph typically by modifying a standard bell conveyor combination having a hydraulic drive. This could operate submerged. The inventor also placed flotation devices within the conveyor's structure thereby allowing (causing) it to float at or preferably just below (slightly below) the water level when the movable conveyor transporting belt structure is substantially fully loaded with and transporting shoring up bulk such as rock or rip rap or other conventional ballast. I preferably utilized ballast of a size and shape consistent with foregoing objects, together with little if any significant projection of the floated distal portion of the conveyor structure and mechanism extending a minor distance above water level when not loaded, but aforenoted slightly below water level when fully loaded. In order for the berth to be accessed at its seaward narrow open end as well as along the berth path all the way to the under pier (or under dock or bridge) bulkhead for eventual deposit of bulk being conveyed by the conveyor combination, the floated (bouyant) conveyor combination was constructed in a narrow elongated shape such that it would be insertable and retractable along its elongated axis along the entire length of the berth path above-noted. Concurrently, either the proximal end or at any intermediate portion thereof of, the conveyor combination has been made accessible for loading bulk thereon when such intermediate portion was not already within the berth path, thereby allowing loading of the moveable conveyor belt like structure devoid of having to move the bulk loading apparatus to follow the proximal end for the loading of bulk prior to transport of loaded bulk along the berth path. In a preferred embodiment, this was; accomplished by supporting the conveyor combination of slide rails supported by one or more barge(s) or boat(s) or the like, by which typically the conveyor belt structure is slung from roller dollies to thereby alloy the conveyor belt structure to be freely extended and retracted to the degree(s) and/or extent (s) and at time(s) as might be required during the utilization thereof. A bulk receiving hopper unit (combination) was built on (at) a predetermined angle, preferably adjustable, adjusted to match a bulk slide rate at which the bulk material was or is required and/or optimally might be placed onto the conveyor like belt structure, taking into consideration other factors such as bulk size and shape and type of bulk material utilized and/or to be utilized therewith.

As aforenoted, in a preferred embodiment, a vibrator was attached to a hopper and/or hopper chute feeding bulk toward and/or onto the conveyor bell structure, to improve ease of handling and/or more control on the rate of material flow of bulk through the hopper system onto the conveyor like structure.

The invention can be utilized for placing bulk material in a sub-aqueous (below water level) environments under piers, docks, warfs, berths, bridges and the like, i.e. in areas/locations where access in general is otherwise denied or limited or inaccessible.

It is within the scope of the invention to be built to accommodate any size and/or length conveyor belt structure as required or as might be required. Initially and typically the invention in prototype was built to fit between piles which were 36 inches on center and a pier fifty feet wide. An eighteen inch wide belt with rollers on two foot centers was built for those required berth working parameters, with a total extended length of the floated conveyor being about fifty five feet. Several other sizes have been now built, utilizable of 36 inch conveyor belt structure in width, and 360 feet in length, for example. Extensive Commercial success in actual experimental commercial utilization thereof extends back several months.

Figure 1C:
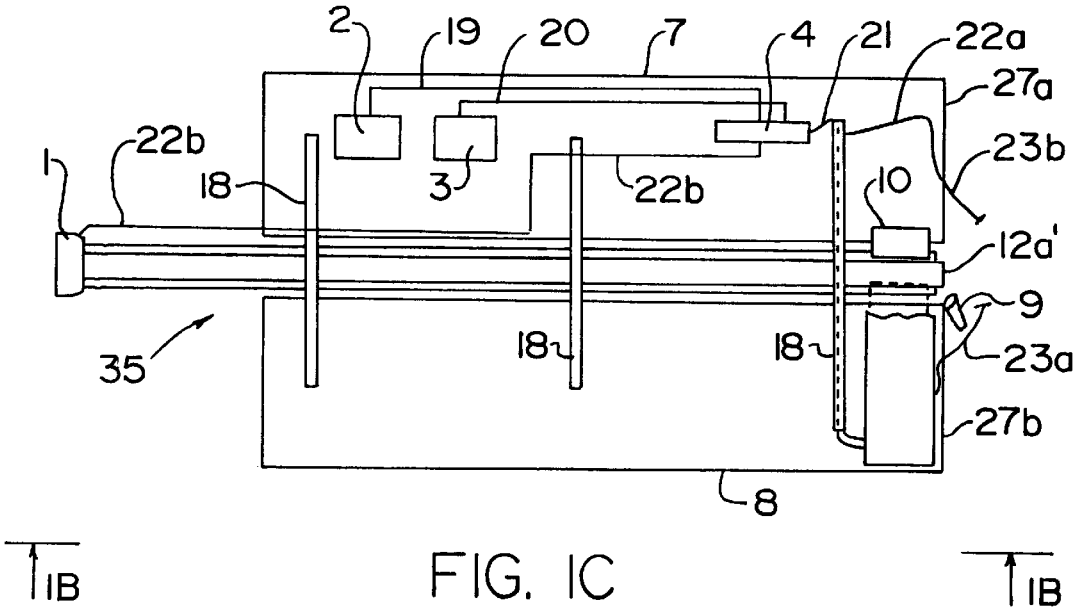
Figure 1B:
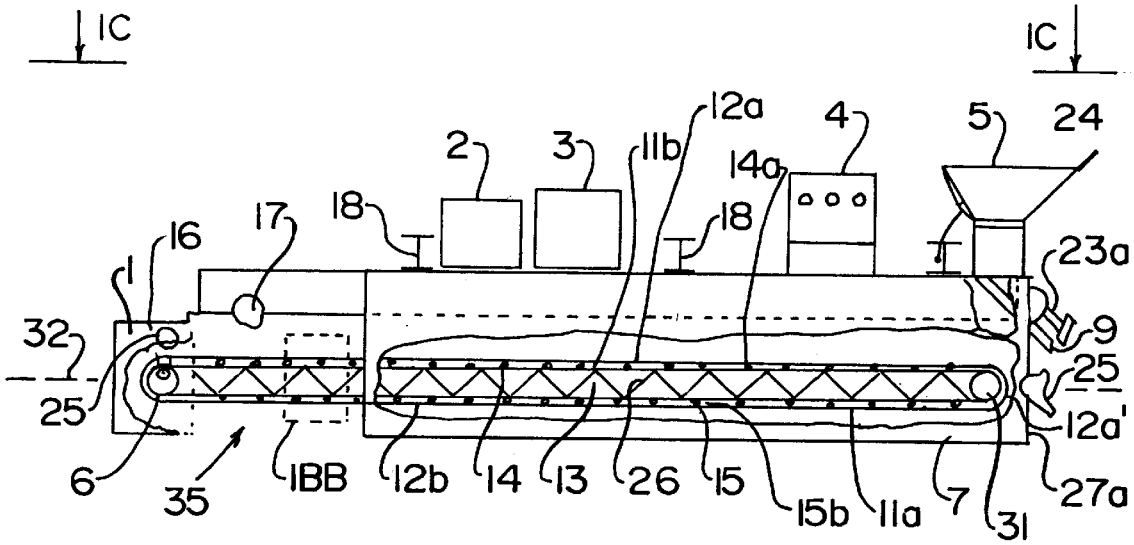

As illustrated in FIG. 1B, showing an operational illustrative embodiment, there is shown a side hopper 25 into which the material is dumped by any number of optional methods and/or mechanisms such as by use of bucket loaders, back hoe, clamshell or conveyor structure one/or by utilization of aforenoted vibrator mechanisms(s)—all being conventional technology.

While a hopper is typically adjustably fixed (set) to fit the current desired production rate of the conveyor system or unit of this invention, and the machine that is feeding it, the range would be typically between one and five cubic yards capacity. The aforenoted operation experimental unit employed, a 1.5 cy slide hopper.

A second normally integral part is the conveyor unit above described, its size being determined by many factors which are governed by the restraints of the specific application intended. Most ballast application of this invention would require the use of stone with typically an average size of one cubic foot and therefore a conveyor belt width of 16 inches would be typically minimal. For other aggregate, a narrower conveyor belt like structure can be utilized although a maximum width has not be as yet determined—however a forty eight inch belt width appearing to be the widest normally necessary for known application to the present date, although could change depending upon future situations. The aforenoted experimental unit utilized an 18 inch conveyor belt like structure width.

A third typical part is the floating combination unit as noted preferably with the track mechanism to center the conveyor, hold it in place and allow it to extend and retract to various positioned required for one or more particular operation(s).

Figure 2C:
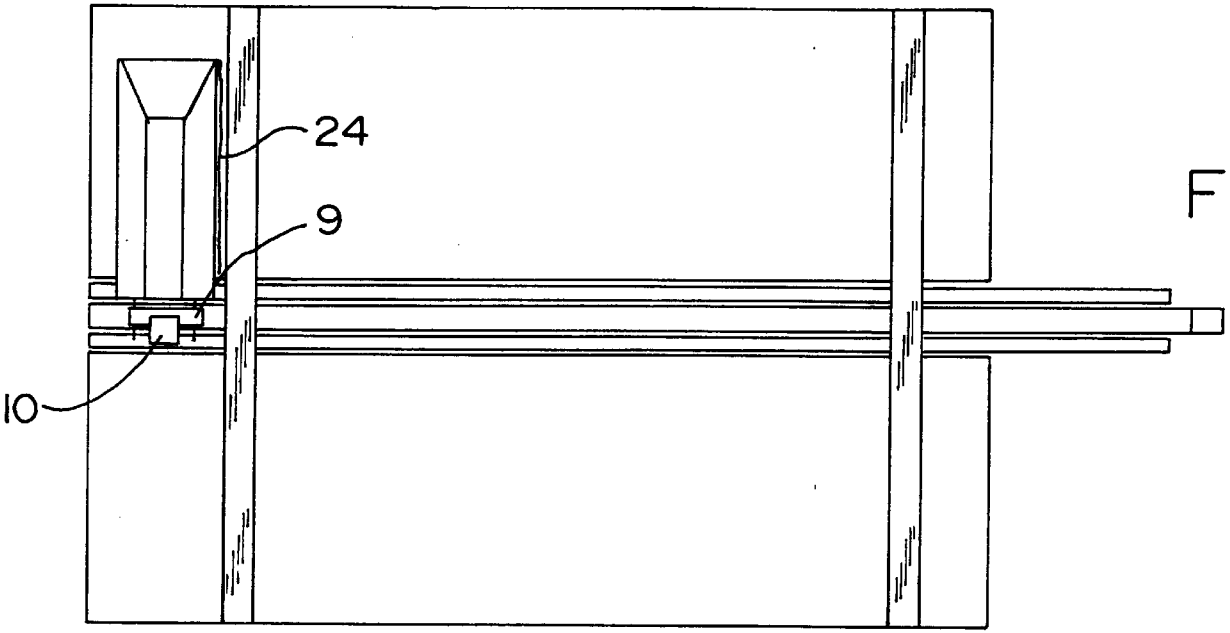
Figure 1B:
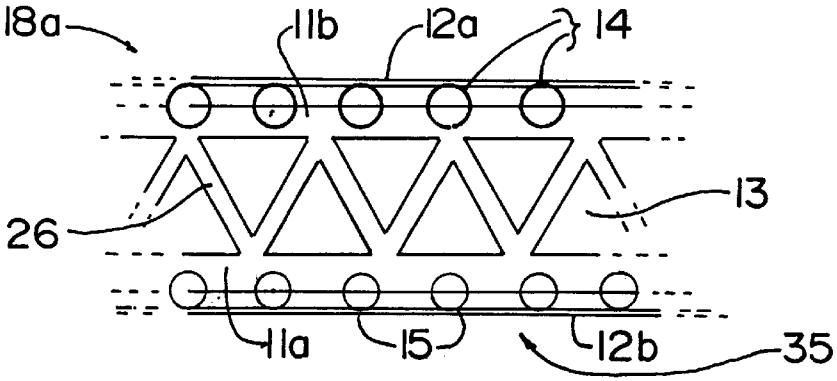
Figure 2A:
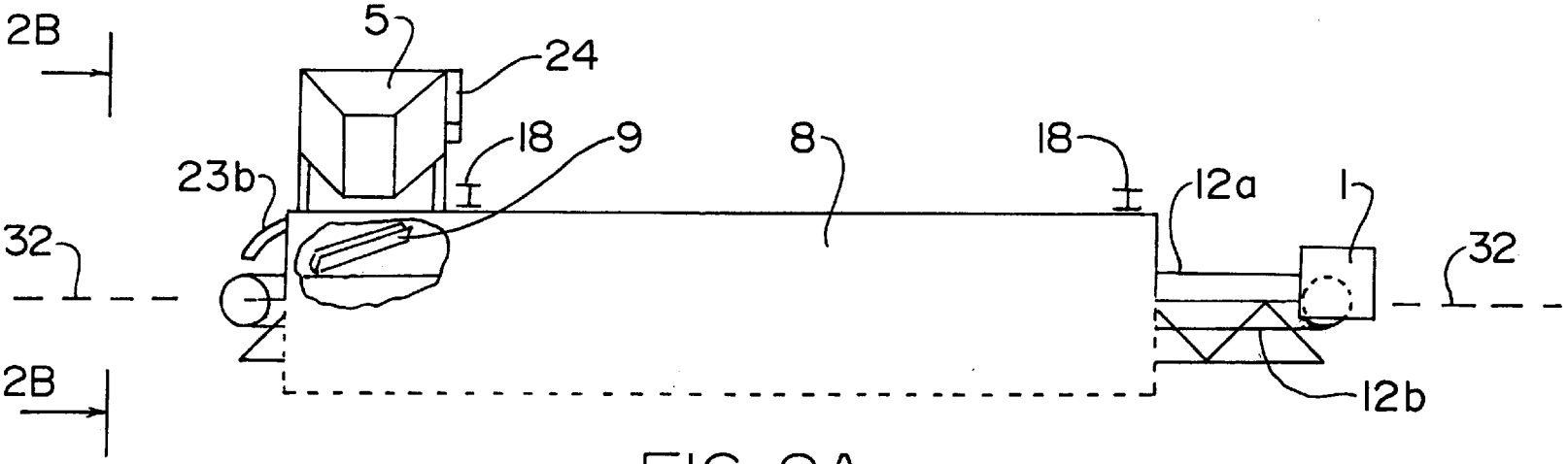
Figure 2B:
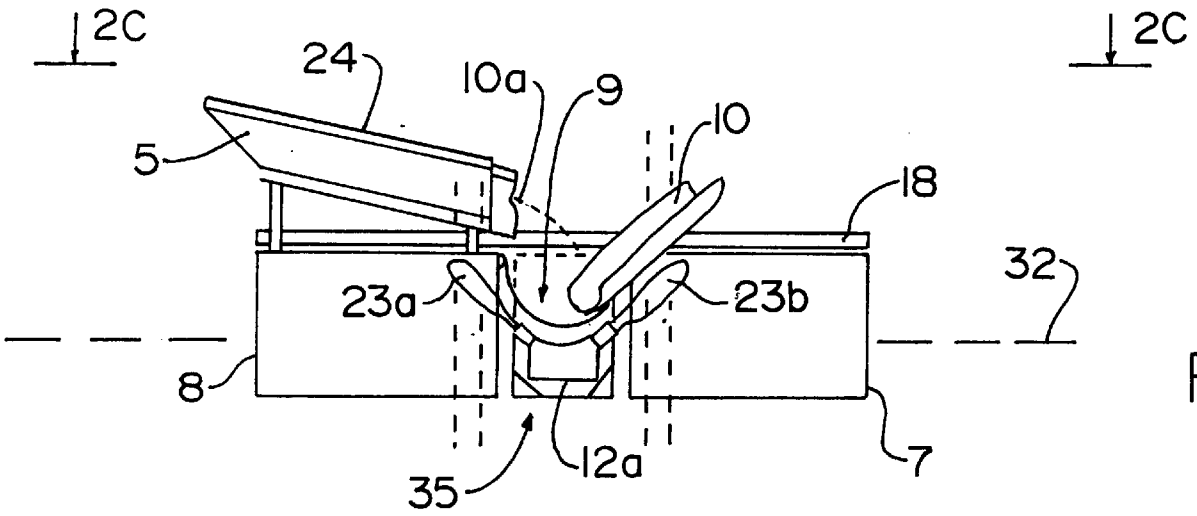

Preferred double hulled versions of the invention, having the extendable bouyant conveyor belt combination therebetween are illustrated in FIGS. 1C, 2B and 2C. An alternate embodiment of a single hulled version of the invention is illustrated in FIG. 3A.

Various ones of the foregoing Figures illustrate adaptations typically adapted for differing specific projects having somewhat differing needs to be met.

At-least the extendable portion of the bouyant conveyor combination has to be limited in the extent of its bouyancy, as to avoid leaving too much of the distal end of the bouyant portion thereof to have an upper surface thereof positioned above water level to too great an extent as would potentially too greatly increase required head room in order to allow the positioning thereof beneath overhang dock or pier or bridge structure, or the like, when devoid of any bulk on a distal end of the conveyor belt like structure thereof. Accordingly, as regards its upper surface at the distal end thereof.

As shown in the embodiment of FIG. 1-B, an intermittently-adjustable truss type structure 11 is utilized preferably to provide sufficient support to give depth that allows the return rollers 26*b* to be positioned below the flotation device(s) to thereby provide the overall bouyant conveyor combination sufficient stability against potential overturning. The design of the truss 11 is based on the bouyant conveyor combination's weight out of the water, since the aggregates stress is in handling the system to alternately install and remove it from the accompanying barge, boat or the like. Since depth of the bouyant conveyor combination is of controlling importance, the ability of the truss to support the bouyant conveyor combination is not generally expected to be a normally bothersome governing factor in other than very long system bouyant combination of about one hundred or more feet in length.

Bouyancy required can be accomplished by several different routes—by building the truss as a buoyant structure such as by use of hollow steel or aluminum tubing sealed to allow air to be entrapped or adding of buoyant material, for example, such as typically styrofoam 13 and/or pontoons, or the like. In general, the weight of the total bouyant conveyor system loaded with the bulk material preferably should substantially equal the total volume of the enclosed unit (system) multiplied by the weight of the water which will vary depending on the degree of salinity.

Further referenced below, indicia-labeled elements are: #1—conveyor drive motor-enclosure, enclosing a conventional hydraulic drive motor; #2—conventional air compressor; #3—conventional hydraulic unit; #4 —conventional operational console (switches, dials, etc.); #5 —slide hopper; #6 —conventional drive pulley; #7—pontoon (barge, etc.); #8—another conventional pontoon (barge, etc.); #9—conventional chute; #10 material guide; #11 i.e. truss frames 11*a* and 11*b*; #12 (i.e. 12*a* and 12*b*—a continuous conveyor belt—upper conveyor belt conveying-portion 12*a* and lower conveyor belt return-portion 12*b;* #13—flotation material (such as styrofoam); #14—top traughing idler—i.e. top rollers; #15—bottom traughing idler—i.e. lower/bottom rollers; #16—conventional drive hydraulic or air motor, #17—push/pull trolley(s)—float-conveyor-structure guide-connector(s) between barge(s) and the float-conveyor structure(s)); #18—I-beam(s) (part(s) of jointed spaced-apart pontoons/barges, forming a I-double beam track(s); #19—conventional air hose connected to each of and between air compressor 2 and operator's console 4; #20—typically hydraulic hose connected to and between operator's consol 4 and typically hydraulic power unit 3; #21—typically air hose to vibrator 24; #22—typically hydraulic hose drivable of drive motor 16; #23*a* and 27*b*—hydraulic positioning cylinder(s) for initially positioning and/or retaining positioning of conveyor float structure combination 35 relative to typically one or more barges; #24—vibrator or vibrating unit/mechanism and structure; #25—adjustable side chute for guiding input (sliding) bulk in variable directions; #26—barge-structure cross-supports; #27*a*—forward end of barge or pontoon 7; #27*b*—forward end of barge or pontoon 8; #28—downwardly-inclined upper surface of sea or bay bottom adjacent a bulkhead; 29—pilings 29 embedded (as previously driven-down) within the sea or bay bottom 28; 30—rocks (or the like) embedded within the sea or bay bottom 28; #31—revolvable change-of-direction return-roller (or drum); #32 typical intermittent sea/water-level beneath pier #33 and bulkhead #34—; #35—the float conveyor structure (mounted adjacent one or between two spaced-apart barges/pontoons; #36*a*—falling dumped bulk; and #36*b*—deposited bottom-resting bulk.

In FIG. 1A a typical right side view of a typical embodiment of the invention as a barge 8 embodiment in a symbolically floating at a typical intermittent water-level 32 state positioned adjacent to an outer edge of a pier or dock 33 that extends outwardly (seawardly) from a supporting bulkhead 34, with the dock supported by pilings 29 embedded within supporting bottom ground 28 typically with embedded bottom bulk (rock(s)) 30. I-beams 18 intermittently or permanently hold spaced-apart pontoons or barges in fixed relationships on opposite edges of a thereby defined space in which is located the floating conveyor (total) structure/combination 35. The motor-drive enclosure 1 has therein the conveyor belt-driving motor driving revolvably the upper conveyor belt portion 12*a* with the reverse-direction portion 12*a*' following arcuately around the return roller 31 for returning lower conveyor belt portion 12*b*. Accordingly, bulk dumped or fed into the slide hopper 5 is thereby directed by the slide hopper into the chute 9 from which the bulk is deposited onto an upper surface of the revolving (revolvable) conveyor belt upper portion. It is at the return belt portion 12*a*' that bulk carried on the conveyor belt upper portion becomes dumped bottom-resting bulk 39*a*.

FIG. 1B a right side of the embodiment of FIG. 1A. Typically as shown in FIG. 1B, to feed bulk to the conveyor belt 12*a* and to provide a reservoir of material, a hopper 5 is typically fitted on at-least one side of the conveyor belt 12*a* with a variable inclined-slide hopper 5 and air activated vibrator(s) 24. At the front/leading end of the barge(s) is/or the hydraulic positioning cylinders 23*a* and 23*b*. The rate at which the material is fed to the conveyor is controlled by varying angle of the incline and/or amount (preferably variable) of vibration of the vibrator(s) 24. Optimal rate of feed of the bulk is normally and preferably controlled by an operator-person (or computer-controlled mechanism), based on feed requirement considering the size of material being moved and thickness of the layer of material deposited or to be deposited, and the like. Also shown are the upper and lower idlers, namely rollers, 14 and 15. Also shown are cross-supports 26.

In FIG. 1BB in an enlarged view of a portion 1BB of FIG. 1B, as greater detail as to structural arrangements of FIG. 1B, with regard to truss-frames 11*a* and 11*b*, the cross-support truss members 26, rollers 14 and 15, upper and lower portions 12*a* and 12*b* of the conveyor belt, styrofoam 13 and the like. FIG. 1BB illustrates a view taken within the lined square of FIG. 1B, showing in greater detail the structural arrangements of elements thereof previously described above. The upper conveyor portion 12*a* rolls along on upper rollers (idlers) 14, and the lower conveyor portion rides along on the lower rollers (idlers) 15. The rollers 14 and 15 are revolvably mounted on the respective substantially horizontal structures (beams) 11*a* and 11*b* which are supported in spaced-apart one over the other relationships illustrated by the angled truss cross-supports 26.

In FIG. 1C in a top view as taken along lines 1C—1C of FIG. 1-B, of the embodiment of FIG. 1B, each of the typically barges 7 and 8 are about ten feet wide and forty feet long. In this FIG. 1C, there are additionally illustrated above-identified elements 19 through 23, namely I-Beam guide rails 18, air hose 19 to console, hydraulic hose 20 to the console 4, air hose 21 to the vibrator 24, hydraulic hose 22 to the drive motor 16, and aforenoted hydraulic positioning cylinders 23*a* and 23*b*.

FIG. 2A illustrates a left side of an alternate embodiment having substantially the same elements (but fewer illustrated) as that of the embodiment of FIG. 1A, showing in cut-away the relative position in side view of the aforenoted chute 9 and again illustrating the hopper and vibrator symbolically.

In FIG. 2B a forward end of the embodiment as taken along lines 2B—2B of FIG. 2A providing a side view of the chute and a front view of the aforenoted chute 9, vibrator 24, bulk dumping path 10*a* from the chute 9 to the downwardly-inclined bulk guide 10, onward into the downwardly-inclined chute 9 which empties the bulk/rocks, etc., onto the conveyor upper portion 12*a* of the floating conveyor combination 35 and the front ends 27*a* and 27*b* of the barges 7 and 8 respectively.

In FIG. 2C an embodiment as taken as a top view along lines 2C—2C of FIG. 2B, more fully illustrating relative positioning of the hopper 5, the bulk guide 10 and the chute 9, in typical spacial relationships from a top view thereof.

In the experimental operative model discussed above, there was employed a truss constructed of angle iron member and styrofoam blocks 13 were inserted inside the truss members in an amount and/or number to substantially equal the total volume of the overall system of the conveyor belt combination of the invention, without regard for point loads at the rear (proximate end drive motors 16 and/or the head (distal end) (larger idler and optional-direction adjustable side chute 25).

More particularly, Figures associated with the aforenoted experimental model are as follow:

Total weight of the bouyant conveyor combination and truss—3750 pounds.

Estimated weight of rip (bulk) when operating: 2500 pounds (1–100 lbs. stone @2×cc).

Total weight in air: 6250 pounds.

A preferred bouyant material: plastic foam blocks with a weight of five pounds per cf in air which would yield sixty pounds/cf of net bouyancy.

In order to offset the 6250 pounds of weight, approximately 105 Cf of styrofoam blocks was installed. The space between the return rollers and the top of the truss allowed placing 2.5 cf of foam per linear foot of truss. Thus, such filled 42 linear feet of truss with foam, allowing room at each end for the drive systems and end section for a total net bouyancy of 6300 pounds.

The total overall combination above described in water would be at the water surface, just fifty pounds of bouyancy when filled with rock (bulk), and when empty would float nine inches above the surface with a net bouyancy of 2550 pounds.

Other material producing bouyancy—depending upon the circumstances, that can be utilized typically including plastic or steel or fiberglass or aluminum or alloy tank(s), inflatable tubes, wood, and pipe truss. However, based on the ease of construction and maintaining low cost economics associated with such construction, styrofoam appear optimal.

In order to be inserted under the dock, the experimental model of the invention utilized installation of a double I beam track 18 and used push trolleys to track in the I-beams. The experimental model utilized a 12 inch I beam to span the double (parallel spaced apart) barges, with an 8 inch I-beam welded to them to form a double beam track. One composite or 3 ton-four roll-ball bearing push trolleys 17 was used on each beam 18. The bouyant conveyor combination was suspended from each trolley by use of ⅝ inch chain in order to have a soft connection to allow for uneven movement of the barge system and the conveyor due to wind wakes and/or wave action.

The bouyant belt-like conveyor combination of the invention being repeatedly subjected to immersion within saline/salty water and operating in salt laden air, must being of such material and/or coatings thereof, as to be reasonably resistant to and durable within such an environment. On that basis, it was determined that air and hydraulic is the optimal choice and preferred drive motors for durable operational embodiments of the above described invention. The drive motor is typically mounted on top of (above) a drive pulley with a chain drive going from its reduction gear off the motor to the drive pulley, and typically and preferably all is/are encased in metal housing enclosure 1 typically sealed therein against water, moisture or air. Typically the hydraulic motor 16 is driven by a power pack 3 mounted topside (on deck) and is plumbed into a master control panel 4.

The bulk material is fed from the hooper 5 onto (into) a chute 9 which guides the bulk material onto a further downwardly-inclined bulk-material guide 10 onto an upper surface of the conveyor belt 12*a* for revolving conveyance thereof toward its distal end 12*a*' previously described. The additional chute 25 is typically positioned suspended from the barge system by use of chain or the like, and positioned in order to allow for a soft connection to compensate for differential movement due to wake and/or wave action, for bulk that is intentionally or unintentionally fed downwardly which by-passes a partially or totally withdrawn entire float conveyor structure 35.

FIG. 1B troughing idlers (rollers) 14 are spaced on typically two foot centers as opposed to standard four to six foot center, since the material is placed on the conveyor belt like structure at normally different intervals—depending upon how far forwardly the distal end of the bouyant conveyor belt combination is or has been advanced at that point in time.

Hydraulic cylinder(s) 23*a* and 23*b* typically are mounted on the front of the barge in order to center the bouyant conveyor belt combination structure in tight (close proximity) operating areas—such as between closely spaced pilings, such bouyant conveyor belt combination structure being too large, heavy and bulky to be solely manually manipulated and/or controlled by workers. Typically a removable side chute 25 is also mounted at the distal end (distribution end) of the bouyant conveyor belt combination structure, which removable side chute can be rotated to thereby spread the material into a wider pattern when required or when lateral movement of that distal end and/or of the entire bouyant conveyor belt combination structure is not otherwise possible.

It is within the scope of the invention to make such variations and modifications as would be obvious to a person of ordinary skill in this particular art.

I claim:

1. An aggregate delivery and depositing apparatus for shoring-up upright underwater support structures of alternately bridges, docks, pier supporting bulkheads and narrowly spaced-apart upright sea bottom-embodied pilings extending upwardly from the sea-bottom to be shored up by aggregate to be deposited thereon, comprising in combination:

at least one first independently self-floating aggregate conveyor means; and a barge adapted to feed the aggregate to the self-floating aggregate conveyor means which is adapted to extend between the narrowly spaced-apart upright sea bottom-embodied pilings and adapted to transport the aggregate from a position substantially at water-level, downwardly toward an ultimate destination for deposit therefrom onto the underwater sea bottom juxtaposed said pilings;

the at least one first independently self-floating aggregate conveyor means further comprising:

a) opposite front and rear ends with an axially-extending length therebetween and a first predetermined width along said axially-extending length thereof; and b) a revolvable conveyor means including an upper portion movable and conveyable along said axially-extending length, said aggregate transportable on said upper portion, said length and width predetermined such that the self-floating aggregate conveyor means is floatably insertable between said narrowly spaced-apart pilings.

2. The aggregate delivery and depositing apparatus of claim 1, including in combination at-least one first floating platform including flotation means thereof separate and apart from said at-least one first floating aggregate-conveyor means, and first floating platform having sufficient mass to anchor and directionally-control orientation and extent of intermittent movement of said at-least one first floating aggregate-conveyor means, and said at-least one first floating aggregate-conveyor means being adjustably intermittently movable relative to and attached to said at-least one first floating platform.

3. The aggregate delivery, and depositing apparatus of claim 2, including a first aggregate-feed means for sequentially aggregate feed-receiving and aggregate feed-transporting and for effecting transfer of transported aggregate onto, said first floating aggregate-conveyor means.

4. The aggregate delivery and depositing apparatus of claim 3, in which said first aggregate-feed means is mounted on said at-least one first floating platform.

5. The aggregate delivery and depositing apparatus of claim 4, including two spaced-apart rigidly-interconnected ones of said one first floating platform with said at-least one first floating aggregate-conveyor means movably attached thereto.

6. The aggregate delivery and depositing apparatus of claim 5, in which said at-least one first floating aggregate-conveyor means is mounted on at-least one of said two spaced-apart rigid-interconnected ones, positioned and movable: (a) therebetween in axially alignment with flotation through-space therebetween in a state of flotation, and b) moveable in a first direction substantially parallel to said first axially elongated length between and independently and apart-from separate movement of said two spaced-apart rigidly-interconnected said one first floating platform, and the at-least one first floating aggregate-conveyor means additionally including conveyor-transporting means for transporting of aggregate along said first axially elongated length.

7. The aggregate delivery and depositing apparatus of claim 6, in which said aggregate-conveyor-transporting means includes at-least one flotation means for floatably supporting a conveyor belt means and said conveyor belt means being additionally for supporting and moving of said aggregate supportable thereon, and a conveyor belt drive means for revolvably driving said conveyor belt means, said conveyor belt means being mounted on and floatably supported by said at-least one flotation means.

8. The aggregate delivery and depositing apparatus of claim 7, in which said flotation means consists essentially of styrofoam.

9. The aggregate delivery and depositing apparatus of claim 7, in which said styrofoam has a width, length and thickness sufficient to maintain said conveyor belt means at a level normally above water level when not conveying aggregate thereon.

10. The aggregate delivery and depositing apparatus of claim 6, in which said at-least one first floating platform includes at-least one linearly-extending side extending in said first linear direction.

11. The aggregate delivery and depositing apparatus of claim 3, in which said first aggregate-feed means comprises an inclined slide structure having first and second opposite ends thereof, the first end thereof being at-least a first opposite end being at least one of elevated and elevatable, and the second opposite end being at-least one of lowered or lowerable such movement of aggregate placed thereon is gravitationally enhanced from the first opposite end toward the second opposite end, and aggregate movement-enhancing means or increasing ease of movement of aggregate from said first opposite end to said second opposite end, said second opposite end being positioned substantially above said conveyor belt means sufficiently for aggregate from said second opposite end to be deposited onto said conveyor belt means.

12. The aggregate delivery and depositing apparatus of claim 11, including vibrator means for vibrating said inclined slide structure such that gravitational movement of said aggregate is enhanced from said first opposite end to said second opposite end.

13. The aggregate delivery and depositing apparatus of claim 11, in which said second opposite end is mounted on said at-least one first floating aggregate-conveyor means.

14. The aggregate delivery and depositing apparatus of claim 11, in which said first opposite end is mounted on said at-least one first floating aggregate-conveyor means.

15. The aggregate delivery and depositing apparatus of claim 2, including a second floating platform substantially rigidly attached to and spaced from said at-least one first floating platform a distance greater than said breadth width dimension and lesser than said length dimension, positioned to restrain said at-least one first floating aggregate-conveyor means in a direction substantially aligned with said first axially elongated length allowable of movement of said at least one conveyor means in said direction intermittently toward and away from predetermined points of deposit of conveyed aggregate.

16. The aggregate delivery and depositing apparatus of claim 15, in which said first aggregate-feed means comprises an inclined slide structure having first and second opposite ends thereof, the first opposite end thereof being at least one of elevated and elevatable, and the second opposite end being at-least one of lowered or lowerable such that movement of aggregate placed thereon is gravitationally enhanced from the first opposite end toward the second opposite end; and aggregate movement-enhancing means for increasing ease of movement of aggregate from said first opposite end to said second opposite end; and said second opposite end is positioned substantially above said conveyor belt means sufficiently for aggregate from said second opposite end to be deposited onto said conveyor belt means.

17. The aggregate delivery and depositing apparatus of claim 16, including vibrator means for vibrating said inclined slide structure such that gravitational movement of said aggregate is enhanced from said first opposite end to said second opposite end.

18. The aggregate delivery and depositing apparatus of claim 17, in which said second opposite end is mounted on said at-least one first flotation means.

19. The aggregate delivery and depositing apparatus of claim 15, in which said flotation means consists essentially of styrofoam.

20. The aggregate delivery and depositing apparatus of claim 19, including guidance structure mounted between and attached to each of said at-least one first floating aggregate-conveyor means, at-least one first floating, platform, and said at-least one first floating platform.

21. The aggregate delivery and depositing apparatus of claim 20, in which said at-least one first floating platform includes at-least one linearly-extending side extending in said first linear direction.

22. The aggregate delivery and depositing apparatus of claim 19, in which said styrofoam has a width, length and thickness sufficient to maintain said conveyor belt means at a level normally above water level when free of conveying aggregate thereon.

23. The aggregate delivery and depositing apparatus of claim 2, including two spaced-apart rigidly-interconnected ones of said one first floating platform with said at-least one first floating aggregate-conveyor means movably attached thereto.

24. The aggregate delivery and depositing apparatus of claim 2, in which said at-least one first floating aggregate-conveyor means has a first breadth width dimension, and has a first axially elongated length exceeding said first width dimension, and said at-least one first floating aggregate-conveyor means being axially mounted onto and intermittently flotation water-surface moveable in a first direction substantially parallel to said first axially elongated length relative to said two spaced-apart rigidly-interconnected said one first floating platform, and the at-least one first floating aggregate-conveyor means additionally being for conveyor-transporting aggregate along said first axially elongated length.

25. The aggregate delivery and depositing apparatus of claim 2, including a second floating platform substantially rigidly attached to and spaced from said at-least one first floating platform a distance greater than said breadth width dimension and lesser than said length dimension, positioned to restrain said at-least one first floating aggregate-conveyor means in a direction substantially aligned with said first axially elongated length allowable of movement of said at least one conveyor means in said direction intermittently toward and away from predetermined points of deposit of conveyed aggregate.

26. The aggregate delivery and depositing apparatus of claim 2, including guidance structure mounted between and attached to each of said at-least one first floating aggregate-conveyor means, at-least one first floating platform, and said at-least one first floating platform.

27. The aggregate delivery and depositing apparatus of claim 1, including a first aggregate-feed means for sequentially aggregate feed-receiving and aggregate feed-transporting and for effecting transfer of transported aggregate onto said first floating aggregate-conveyor means.

28. The aggregate delivery and depositing apparatus of claim 1, in which said first aggregate-feed means is mounted on said at-least one first floating platform.

29. The aggregate delivery and depositing apparatus of claim 1, in which said at-least one first floating aggregate-conveyor means includes a flotation means and a conveyor belt means for supporting and moving of said aggregate supportable thereon, and a conveyor belt drive means revolvably drivable of said conveyor belt means, said conveyor belt means being mounted on and floatably supported by said flotation means.

* * * * *